United States Patent [19]

Amos

[11] Patent Number: 4,823,510

[45] Date of Patent: Apr. 25, 1989

[54] SECURITY DOOR SYSTEM

[76] Inventor: Everett A. Amos, P.O. Box 396, Kenbridge, Va. 23944

[21] Appl. No.: 37,992

[22] Filed: Apr. 14, 1987

[51] Int. Cl.[4] ..... E05D 11/10

[52] U.S. Cl. ..... 49/383

[58] Field of Search ..... 49/383, 460, 462, 384

[56] References Cited

U.S. PATENT DOCUMENTS

| | | | |
|---|---|---|---|
| 3,636,659 | 1/1972 | Bylicki | 49/383 |
| 3,911,622 | 10/1975 | Prohaska | 49/383 |
| 4,435,921 | 3/1984 | Marin | 49/383 X |
| 4,640,052 | 2/1987 | Zebedee et al. | 49/383 |

*Primary Examiner*—Philip C. Kannan

*Attorney, Agent, or Firm*—Birch, Stewart, Kolasch & Birch

[57] ABSTRACT

The present invention relats to a security door system for a hinged door and the like. More specifically, this security door system consists of a door, a door frame with a jamb aligned substantially parallel to the door, a plurality of hinges and a security bolt device. The security bolt device consists of two plates positioned on opposing sides of the door and along the hinged edge of the door. A security bolt protrusion positioned on the top side of the interior plate of the security bolt device is inserted into corresponding apertures along the door jamb. When the door is closed, the bolts along the hinged edge are positioned within the apertures to preclude removal of the door by merely removing hinge pins from the door hinges.

5 Claims, 2 Drawing Sheets

SECURITY DOOR SYSTEM

BACKGROUND OF THE INVENTION

1. Field of the Invention

The present invention relates to a security door system for a hinged door and the like. More specifically, this security door system consists of a door, a door frame with a jamb aligned substantially parallel to the door, a plurality of hinges and a security bolt device. The security bolt device consists of two plates positioned on opposing sides of the door and along the hinged edge of the door. A security bolt protrusion positioned on the top side of the interior plate of the security bolt device is inserted into a corresponding aperture along the door jamb. When the door is closed, the protrusion along the hinged edge is automatically inserted into the corresponding aperture to preclude removal of the door by merely removing hinge pins from the door hinges.

2. Description of Related Art

In conventional door arrangements, a door is normally suspended on hinges connected to a door jamb and frame with a door knob assembly incorporating a locking apparatus. The hinges suspending the door consist of a first hinge plate affixed to the door and a second hinge plate affixed to the door jamb. The two hinge plates are connected together and pivot about a common hinge pin which can be easily inserted between the two plates to enable the door to open or close. However, a potential security problem exists when the door is required to be opened outwardly. For example, some states require that doors on commercial buildings must open outwardly to avoid injuries to persons exiting the building. Because the door is required to open outwardly, the hinges, and more importantly, the hinge pins are exposed. Therefore, if the door is closed and locked, a person can easily remove the door from the hinge side and gain access to the building by merely removing the hinge pins.

Accordingly, a need exists in the art for a means to secure an outwardly opening door which cannot be easily removed by merely tampering with the hinge pins. This device should be easily usable for newly manufactured doors or also for modification of currently existing doors.

SUMMARY OF THE INVENTION

Accordingly, it is a primary objective of the invention to provide a security door system for an outwardly opening hinged door.

It is another objective of the present invention to provide a security bolt device which is simple to install on currently existing hinged commercial doors.

It is a further objective of the present invention to provide a security door system that operates independently of the hinges in conventional doors.

It is yet another objective of the present invention to provide an inexpensive and efficient device for securing outwardly opening hinged doors.

A further objective of the present invention is to provide a security door system and device that is easy to install and inexpensive to manufacture.

Yet another objective of the present invention is to provide a security door system that can be easily incorporated into newly manufactured doors.

These and other objectives of the present invention are fulfilled by providing a security door system, comprising:

a door having first and second major surfaces and a plurality of minor surfaces extending around the perimeter of the door defining door edges, said first major surface defining the interior side of the door and second major surface defining the exterior side of the door;

a door frame at least partially surrounding said door, said door frame including a jamb aligned with the minor surfaces of said door when said door is in a closed position, said door having at least one aperture extending into said jamb;

hinge means connected to an edge of said door for pivotally supporting the door on said door jamb;

lock means positioned on a door edge opposite the edge on which said hinge means is connected for maintaining said door in a closed position; and security bolt means aligned along the hinged edge of said door and including a protrusion for automatically inserting said protrusion within said at least one aperture in response to the swinging motion of the door.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
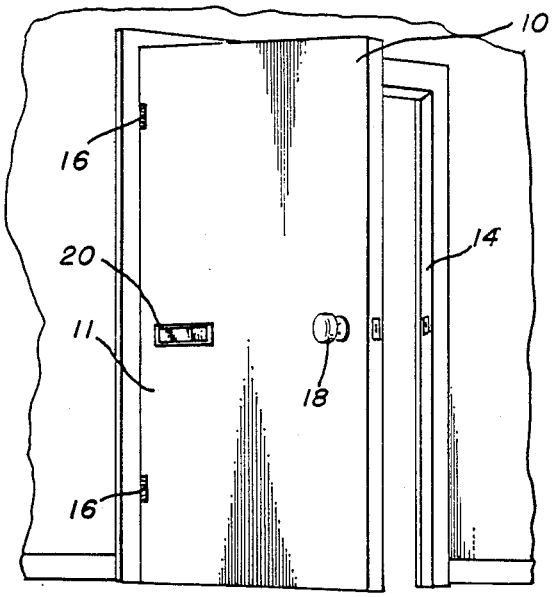
FIG. 1 is a perspective view of the exterior surface of an outwardly opening door.

Referring in detail to the drawings and with particular reference to FIG. 1, the exterior side 11 of an outwardly opening door is shown. The door 10 is suspended from the jamb 14 by two hinges 16, respectively. When the door 10 is closed and the door knob assembly 18 is locked, the door 10 can still be easily removed from the frame 14 by merely removing the hinge pins of the hinges 16.

Figure 2:
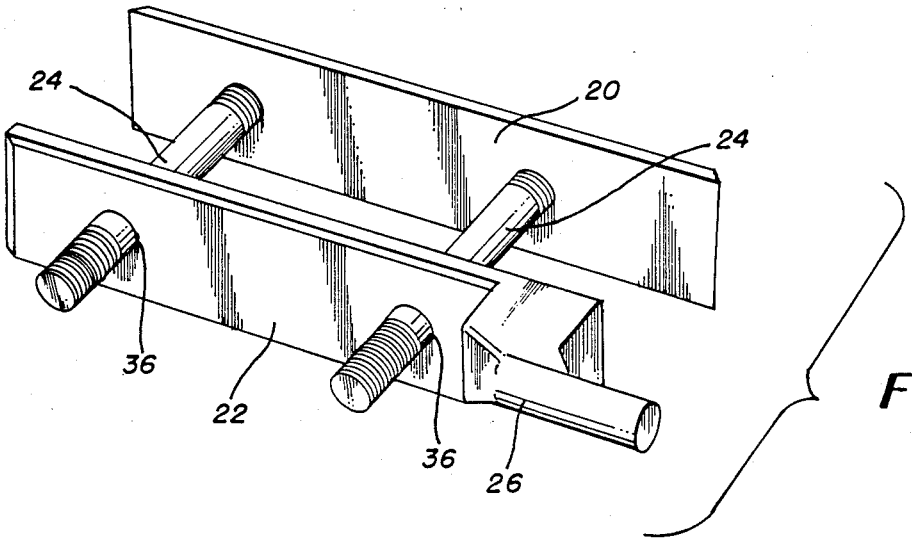
FIG. 2 is a rear perspective view of the security bolt assembly of the present invention.
Figure 3:
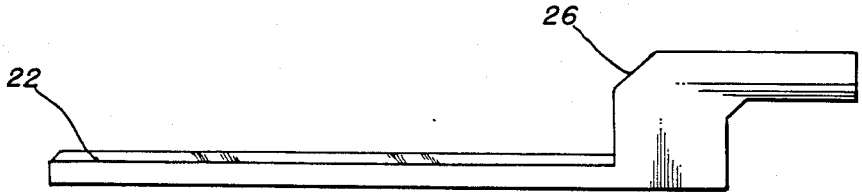
FIG. 3 is a side elevational view of the interior plate and bolt of the security bolt assembly of FIG. 2.
Figure 4:
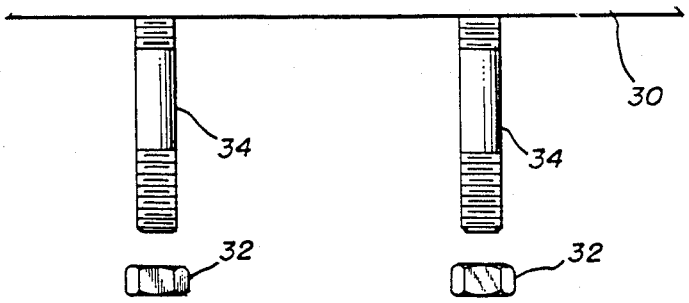
FIG. 4 a side elevational view of the exterior plate of the security bolt assembly of FIG. 2 with connecting bolts and accompanying threaded caps.

The security bolt device as seen in FIGS. 2–4, is composed of an exterior plate 20 connected by two bolts 24 to an interior plate 22. The interior plate 22 includes a security bolt protrusion 26 for insertion into a corresponding aperture along a door jamb. The security bolt protrusion 26 is extended past one edge of the interior plate 22 and offset inwardly from the door to allow for easy insertion and removal from the corresponding aperture along the jamb in response to the swinging action of the door. Also, the interior plate 20 and exterior plate 22 have beveled edges around the perimeter of each to prevent tampering with the security bolt device once it is affixed to the door.

Figure 5:
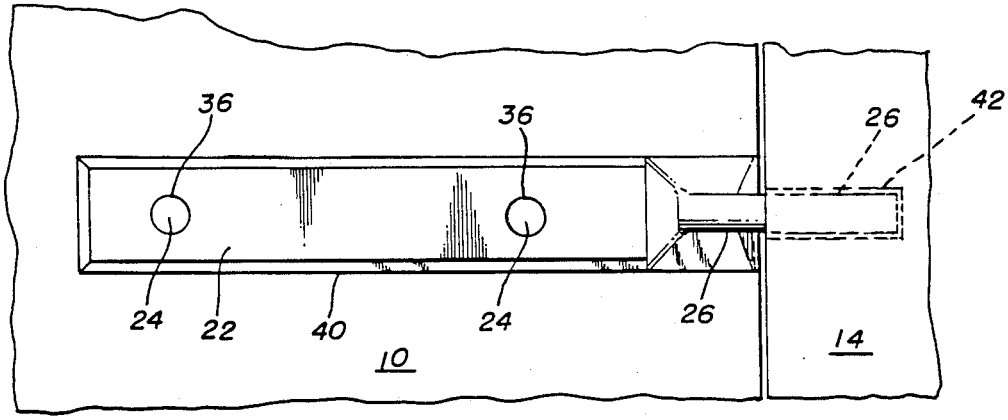
FIG. 5 is an elevational view of the interior plate as shown in FIG. 3 as connected to a door and inserted in a door jamb when the door is in a closed position.
Figure 6:
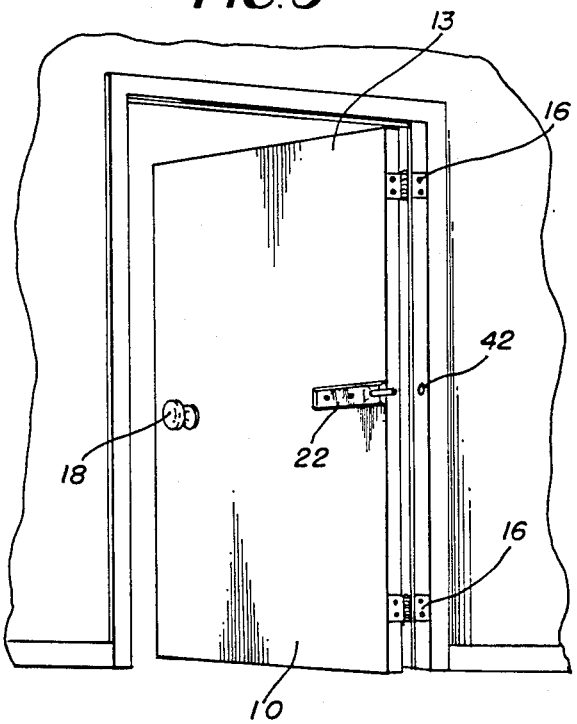
FIG. 6 is a perspective view of the interior surface of a door incorporating the security bolt assembly of the present invention.

When installed, the exterior plate 20 is juxtaposed on the exterior side 11 of the door 10 along the hinged side of the door as shown in FIG. 1. As the exterior plate 20 is positioned, the connecting bolts 24 are engaged through corresponding apertures in the major surfaces of the door and the interior plate 22. After being positioned on opposing sides of the door, the exterior and interior plates are securely held in position by two threaded caps 32. As seen in FIGS. 5 and 6, the exterior plate 20 of the security bolt assembly is affixed to the interior side of the door 10 along the hinged edge and independent of the positions of the hinges 16. When the door is moved to a closed position as shown in FIG. 5, the security bolt protrusion 26 engages the corresponding aperture 42 of the door jamb 14. When the door is opened, as shown in FIG. 6, the protrusion 26 easily passes out of the aperture 42 and does not affect the door's normal operation. Also, the security device 22 is positioned independent of the relative position of the hinges 16 along the door edge. This enables the device to be easily installed on existing conventional door systems that are required to open outwardly.

The security bolt protrusion 26 of the security bolt assembly automatically extends into aperture 42 in the door jamb in response to the swinging motion of the door as it pivots about the hinges to a closed position. Accordingly, a separate manual actuator is not needed for the security bolt protrusion 26.

Further, the security bolt system can also be incorporated into the actual structure of the door by merely providing for the security bolt protrusion with corresponding apertures along the door jamb.

The invention being thus described, it will be obvious that the same may be varied in many ways. Such variations are not to be regarded as a departure from the spirit and scope of the invention, and all such modifications that would be obvious to one skilled in the art are not intended to be included within the scope of the following claims.

What is claimed is:

1. A security door system, comprising:

a door having first and second major surfaces and a plurality of minor surfaces extending around the perimeter of the door defining the door edge, said first major surface defining the interior side of the door and second major surface defining the exterior side of the door;

a door frame at least partially surrounding said door, said door frame including a jamb aligned with the minor surfaces frame of said door when said door is in a closed position, said door having at least one aperture in said jamb;

a plurality of hinges for pivotally supporting said door on said door frame, said hinges including a first hinge plate attached to the door edge and a second hinge plate connected to said door jamb, said first hinge plate and said second hinge plate being pivotally connected with a removable hinge pin accessible from the exterior side of said door;

a hinge security bolt means positioned along the hinged edge of said door including an exterior plate juxtaposed to the exterior side of said door, and an interior plate juxtaposed to the interior side of said door and aligned in a plane substantially parallel to the exterior plate; said interior plate including a security bolt protrusion offset from and longitudinally extending along a major surface and beyond an edge of said interior plate whereby said protrusion is so disposed with respect to said at least one aperture that the protrusion is automatically inserted within said at least one aperture in response to the swinging motion of the door about said hinges to a closed position; and connecting means for connecting said interior plate to said exterior plate and for affixing said hinge security bolt means to said door.

2. A security door system as recited in claim 1, wherein said connecting means comprises a plurality of threaded bolts connected to an inner surface of said exterior plate, said interior plate and said door including corresponding apertures for receiving said threaded bolts, and a plurality of threaded caps corresponding to each said threaded bolt whereby the exterior and interior plates are securely positioned on opposing sides of said door.

3. A security door system as recited in claim 1 wherein said exterior plate includes a beveled edge extending along the perimeter of the outer surface of said exterior plate.

4. A security door system as recited in claim 1 wherein said interior plate includes a beveled edge extending along the perimeter of the outer surface of said interior plate.

5. A security door system as recited in claim 1 further comprising a door knob assembly connected to said door and adjacent to said jamb for maintaining the door in a closed locked or opened position.

* * * * *